US005947615A

United States Patent [19]

Yokoi

[11] Patent Number: 5,947,615

[45] Date of Patent: Sep. 7, 1999

[54] RECORDING APPARATUS

[75] Inventor: Katsuyuki Yokoi, Yokohama, Japan

[73] Assignee: Canon Kabushiki Kaisha, Tokyo, Japan

[21] Appl. No.: 08/902,835

[22] Filed: Jul. 30, 1997

[30] Foreign Application Priority Data

Aug. 1, 1996 [JP] Japan ..... 8-203335

[51] Int. Cl.[6] ..... B41J 11/20

[52] U.S. Cl. ..... 400/56; 400/636.3; 347/104

[58] Field of Search ..... 347/3, 1, 8, 33, 347/42, 104, 108, 114; 346/134, 140.1; 400/56, 58, 636, 636.2, 636.3, 637, 637.6

[56] References Cited

U.S. PATENT DOCUMENTS

| | | | |
|---|---|---|---|
| 4,227,819 | 10/1980 | Manriquez | 400/56 |
| 4,461,212 | 7/1984 | Geney | 400/56 |
| 4,620,807 | 11/1986 | Polit | 400/56 |
| 4,705,413 | 11/1987 | Arnoldi et al. | 400/56 |
| 4,755,836 | 7/1988 | Ta et al. | 346/140.1 |
| 5,580,042 | 12/1996 | Taniguro et al. | 400/636.3 |
| 5,594,486 | 1/1997 | Kiyohara | 347/104 |

FOREIGN PATENT DOCUMENTS

| | | | |
|---|---|---|---|
| 37217A1 | 10/1981 | European Pat. Off. . | |
| 0 337 275 | 10/1989 | European Pat. Off. | 400/56 |
| 721847A1 | 7/1996 | European Pat. Off. . | |
| 751001A2 | 1/1997 | European Pat. Off. . | |
| 6-47966 | 2/1994 | Japan | 400/636.3 |
| 4-115197 | 4/1994 | Japan | 400/56 |

*Primary Examiner*—Christopher A. Bennet

*Attorney, Agent, or Firm*—Fitzpatrick Cella Harper & Scinto

[57] ABSTRACT

The present invention provides a recording apparatus in which a recording medium is conveyed by a driven rotary member and a convey rotary member urged against the driven rotary member by a biasing means supported by a rockable support member, so that an image is recorded on the recording medium contacted with the driven rotary member by a recording means disposed at a downstream side of the convey rotary member. Wherein, when the convey rotary member is rotated in the recording medium conveying direction, the support member is shifted toward a direction for urging the convey rotary against the driven rotary member, by a rotational force of a rotation drive transmitting member of the convey rotary member, so that convey accuracy of the recording medium is improved and the good recording is performed.

16 Claims, 8 Drawing Sheets

RECORDING APPARATUS

BACKGROUND OF THE INVENTION

1. Field of the Invention

The present invention relates to a recording apparatus for conveying a recording medium and for recording an image on the recording medium in an image forming apparatus such as a printer, a copying machine, a facsimile and the like.

2. Related Background Art

In conventional recording apparatuses for recording an image on a recording medium by using a recording means such as a recording head, there are provided a convey roller disposed at an upstream side of a recording position including a recording head and an urging member urged against the convey roller, and the recording medium is pinched between the urging member and the convey roller and conveyed by them. The position of the convey roller is fixed, and the urging member can be moved toward and away from the convey roller. Thus, a recording medium conveying surface of the convey roller is maintained at a constant level and an urging surface of the urging member which is contacted with the recording medium is rocked.

Hence, when a thickness of the recording medium is changed, a distance between the recording head and a recording surface of the recording medium is changed. That is to say, in case of a thick recording medium such as an envelope, the distance between the recording head and the recording surface of the recording medium becomes small in comparison with a thin recording medium such as a cut sheet. As a result, the recording quality is changed or the recording medium is caught by a carriage when the carriage performs main scan to thereby make the scanning operation of the carriage impossible. To avoid this, as disclosed in U.S. Pat. No. 4,755,836, there has been proposed a mechanism in which a distance between the recording head and recording surface of the recording medium is kept constant.

FIGS. 8 and 9 show such a conventional mechanism. FIG. 8 is a sectional view of a so-called serial printer in which a recording head scans along a main scan direction, taken at a plane perpendicular to the main scan direction, and FIG. 9 is a partial view of a carriage, viewed from a direction shown by the arrow A in FIG. 8.

In FIGS. 8 and 9, the reference numeral 101 denotes a carriage on which a recording head is mounted and which is reciprocally shifted in a main scan direction; 102 denotes a carriage shaft along which the carriage is shifted; 103 denotes a small roller; 104 denotes a roller lever for holding the small roller 103; 105 denotes a rail disposed in parallel with the carriage shaft 102; 106 denotes a convey roller for conveying a recording medium; 107 denotes an urging member for generating a conveying force by urging the recording medium against the convey roller; and 108 denotes a spring disposed between the roller lever 104 and the carriage 101. The small roller 103 held on the roller lever 104 is urged against the rail 105 by the action of the spring 108. As the reaction, the carriage is subjected to a force for rotating the carriage around the carriage shaft 102 in a clockwise direction (FIG. 8). A projection 101*a* formed on the carriage 101 is always contacted with the urging member 107 by a force for rotating the carriage toward the urging member. Thus, a distance between the recording head (not shown) mounted on the carriage 101 and the urging member 107 is maintained to a predetermined distance or more. Accordingly, even when the thickness of the recording medium is changed, a distance between the recording surface of the recording medium and the carriage (and accordingly the recording head) is always kept constant, to thereby prevent the recording medium from being caught by the carriage (i.e., preventing the scanning operation of the carriage from being impossible).

However, in the above-mentioned conventional technique, since the distance between the carriage tending to rotate around the carriage shaft and the urging member is kept constant by contacting the projection of the carriage with the urging member, when the thickness of the recording medium is changed, an amount of rotation of the carriage around the carriage shaft in an anti-clockwise direction is changed. As a result, a printing angle of the carriage (and accordingly the recording head) with respect to the recording medium is changed, so that the desired printed result cannot be obtained.

Further, since the position of the projection is shorter than the recording position of the recording head regarding the carriage shaft (rotation center), dispersion in length of the projection affected an influence upon the distance between the recording head and the recording surface of the recording medium. Thus, the distance between the recording head and the recording surface of the recording medium is changed every recording apparatus, and, thus, the recording quality is changed every recording apparatus. To avoid this, the length of the projection must be controlled accurately to keep such distance constant, to thereby make the apparatus more expensive.

Since the projection is always urged against the urging member, when the main scan of the carriage is repeated, the projection is gradually worn, so that the distance between the recording head and the recording surface of the recording medium is gradually changed, to thereby change the recording quality.

SUMMARY OF THE INVENTION

To eliminate the above-mentioned conventional drawbacks, according to one aspect of the present invention, in a recording apparatus wherein a recording medium is conveyed by a driven rotary member having a fixed position and a convey rotary member urged against the driven rotary member by a biasing means supported by a pivotable support member, and an image is recorded on a surface of the recording medium which is contacted with the driven rotary member by a recording means disposed at a downstream side of the convey rotary member in a recording medium conveying direction. Wherein, when the convey rotary member is rotated in the recording medium conveying direction, the support member is shifted toward a direction that for urging the convey rotary against the driven rotary member, by a rotational force of a rotation drive transmitting member of the convey rotary member.

According to another aspect of the present invention, in a recording apparatus comprising a convey rotary member rotatable to apply a conveying force to a recording medium, a driven rotary member rotatingly driven by the convey rotary member, a holding member for holding the convey rotary member, a rotation drive transmitting member attached to the holding member and adapted to transmit a driving force to the convey rotary member, and a recording means disposed at a downstream side of the convey rotary member in a recording medium conveying direction to record an image on a surface of the recording medium which is contacted with the driven rotary member. Wherein, the holding member is supported for pivotal movement around a rotation center of the rotation drive transmitting member, and a position of the convey rotary member is made pivotable with respect to the driven rotary member having a fixed position.

When the convey rotary member is rotated in the recording medium conveying direction, the rotation drive transmitting member having the rotation center for the holding member may be rotated in a direction for generating a force for urging the convey rotary member against the driven rotary member. The driven rotary member may serve to position the recording surface of the recording medium with respect to the recording means.

The recording apparatus may be of ink jet recording type in which the recording is effected by discharging ink from the recording means in response to a signal. The recording means may include an electrical/thermal converter for generating thermal energy for discharging the ink.

The recording means may discharge the ink from a discharge opening by utilizing film-boiling generated in the ink by applying thermal energy to the ink by means of the electrical/thermal converter.

DETAILED DESCRIPTION OF THE PREFERRED EMBODIMENTS

Figure 1:
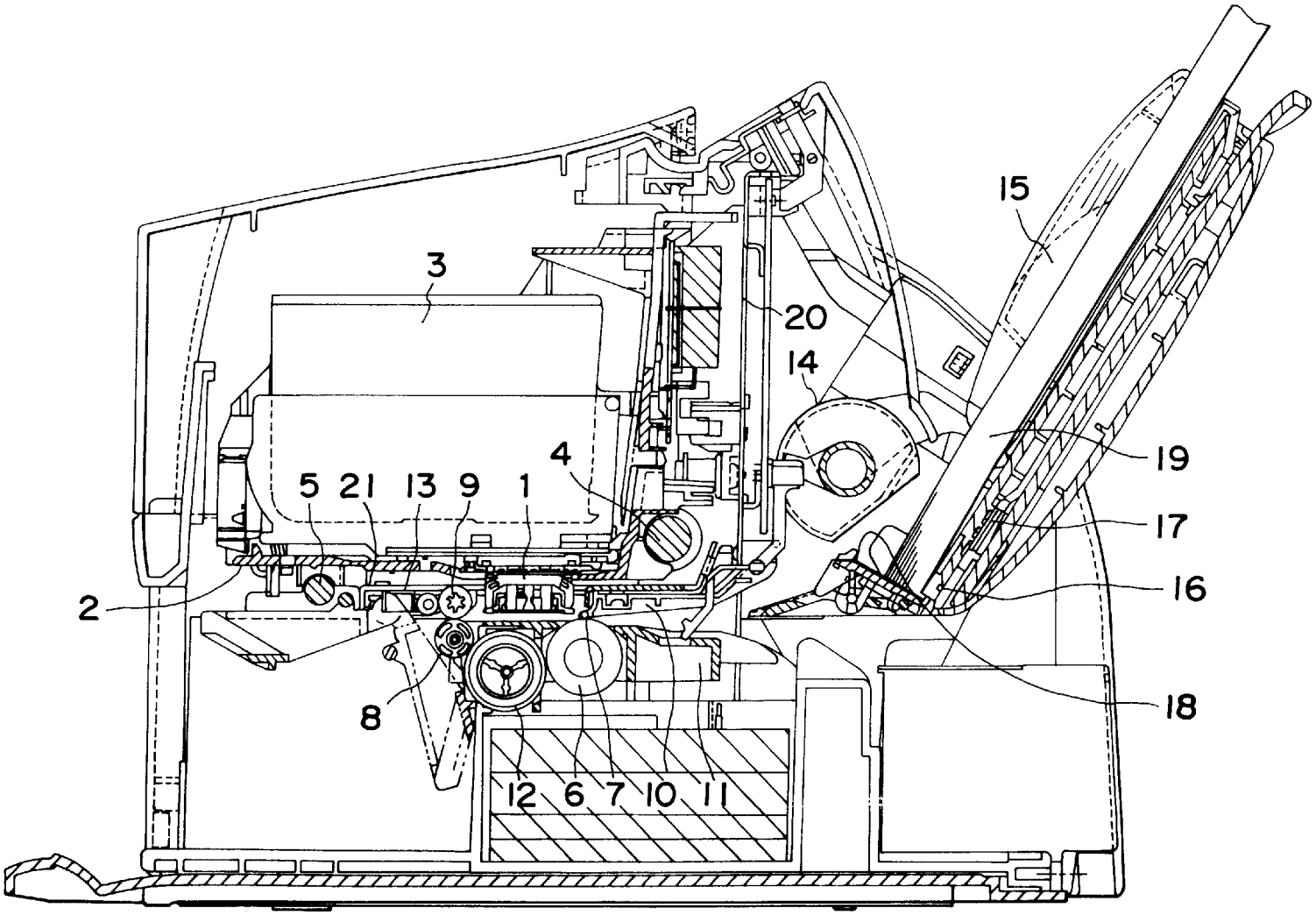
FIG. 1 is a sectional view of a recording apparatus according to an embodiment of the present invention.

Now, an embodiment of the present invention will be explained. FIG. 1 is a sectional view showing an example of a serial recording apparatus having a specific recording medium conveying means, taken at a plane perpendicular to a main scan direction of the apparatus.

The recording apparatus include an ink jet recording head 1 for effecting the recording on a recording medium, a carriage 2 on which the ink jet recording head 1 is mounted for effecting a scanning operation in a main scan direction, an ink tank 3 for supplying ink to the ink jet recording head 1 mounted on the carriage 2, carriage shaft 4, 5 for guiding the carriage 2 during the main scan, a convey roller 6 adapted to convey the recording medium and disposed at an upstream side of a recording area (where the recording is effected on the recording material by the ink jet recording head 1) in a recording medium conveying direction, a driven roller 7, and a driven roller holding member 10 for holding the driven roller 7. The recording apparatus further includes a second convey roller 8 to convey the recording medium and disposed at a downstream side of the recording area (where the recording is effected on the recording material by the ink jet recording head 1) in the recording medium conveying direction, a second driven roller 9 associated with the second convey roller 8, a convey roller holding member 11 for holding the convey roller 6 by engaging by a shaft of this convey roller, a transmission roller 12 urged against the convey roller 6 and the second convey roller 8 by springs (not shown) to transmit a driving force of the convey roller 6 to the second convey roller 8, and a second driven roller holding member 13 for holding the second driven roller 9. The recording apparatus also includes a sheet supply roller 14 for supplying the recording medium 19 to the convey roller 6, a sheet supply stacker 15 on which the recording media 19 are stacked, a pressure plate 16, pressure plate springs 17, a separation pawl 18 for separating the recording medium from the other recording media, a chassis 20, and a holding plate 21 for holding the driven roller holding member 10 and the second driven roller holding member 13.

The recording head (recording means) 1 is disposed in a confronting relation to a platen and is of ink jet recording type in which the recording is effected by discharging from the recording head 1 toward the recording medium. That is to say, the recording head 1 includes fine liquid discharge openings (orifices), liquid passages, energy acting portions disposed in the respective liquid passages, and energy generating means for generating liquid droplet forming energy acting on the liquid positioned at the energy acting portions.

Regarding energy generating means for generating such energy, there are a recording method using an electrical/mechanical converter such as a piezo element, a recording method using an energy generating means for discharging a liquid droplet by a heating action caused by irradiation of electromagnetic wave such as laser, and a recording method using an energy generating method for discharging liquid by heating the liquid by an electrical/thermal converter such as a heat generating element having a heat generating resistance body. Among them, a recording head used in an ink jet recording method for discharging liquid by thermal energy can obtain an image having high resolving power since liquid discharge openings (orifices) for discharging recording liquid droplets can be arranged with high density. Among them, a recording head using the electrical/thermal converter as the energy generating means is particularly effective, because it can easily be made compact, can effectively utilize the advantages of IC techniques and micro working techniques which has been remarkably progressed with high reliability in a recent semiconductor field, can be mounted with high density and can be manufactured cheaply.

Figure 2:
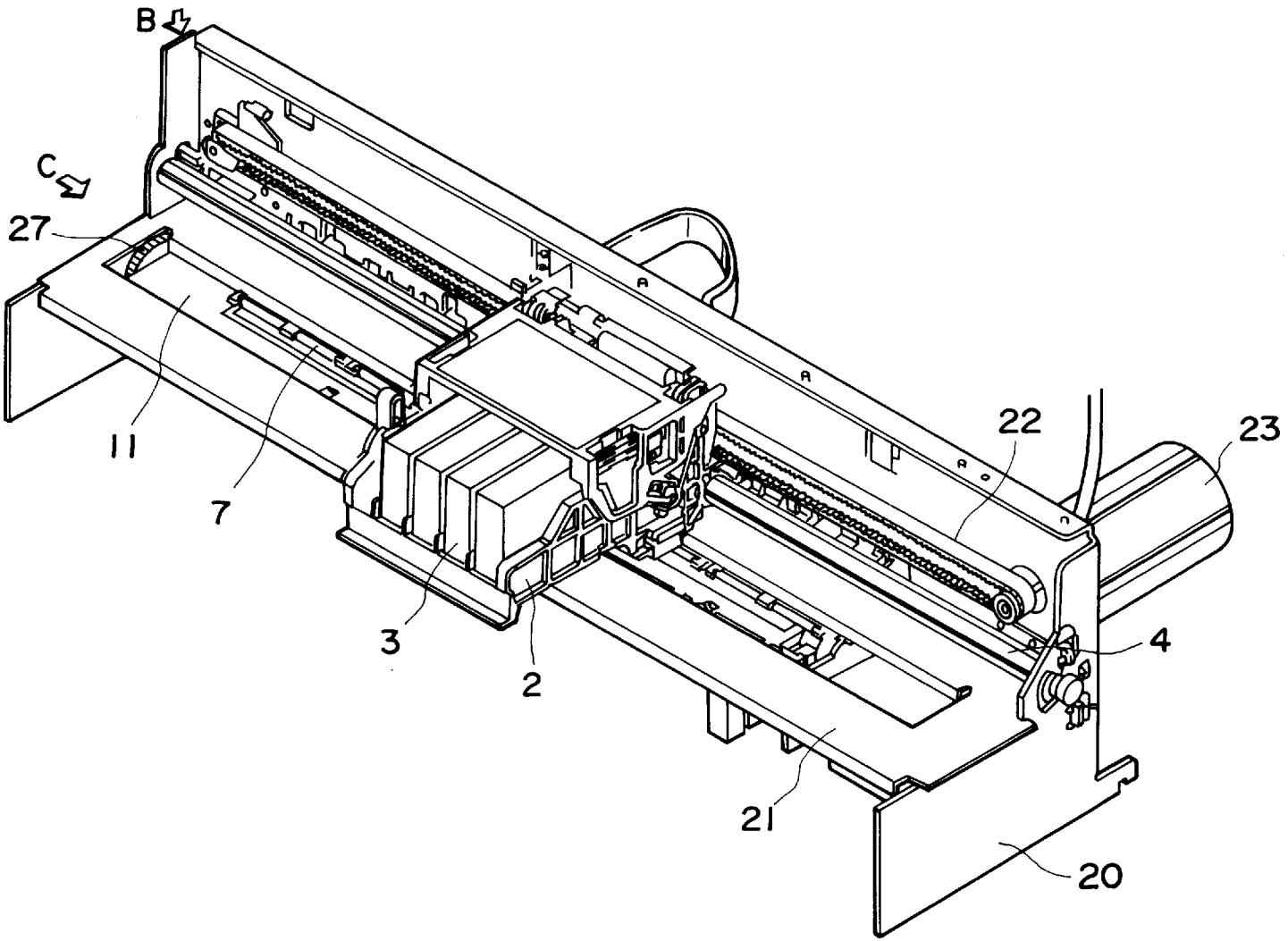
FIG. 2 is a perspective view of the recording apparatus of FIG. 1.

FIG. 2 is a schematic perspective view showing a main part of the embodiment of the present invention shown in FIG. 1. In FIG. 2, the carriage 2 is driven by a carriage motor 23 via a carriage belt 22.

Figure 3:
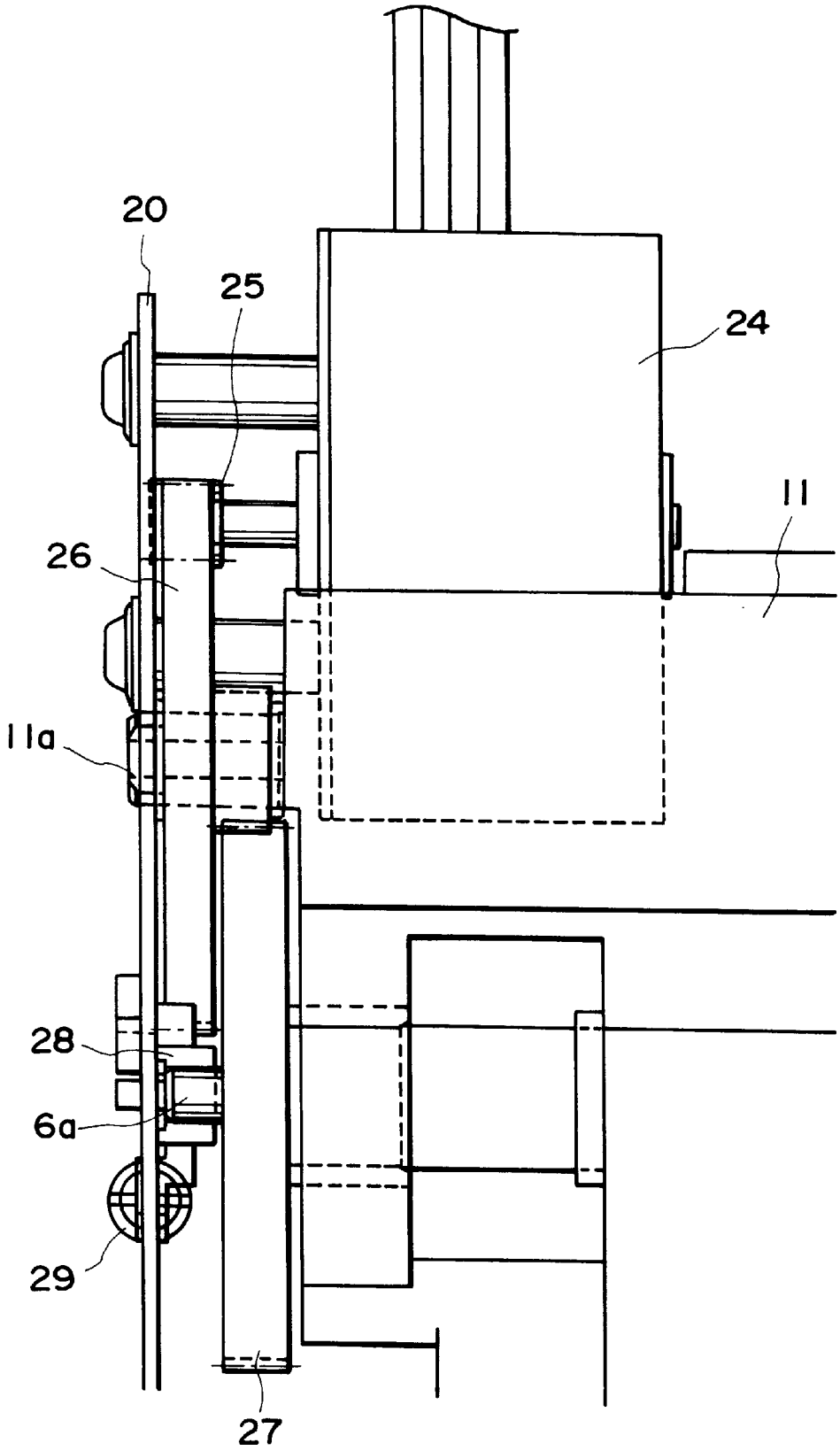
FIG. 3 is a plan view, viewed from a direction shown by the arrow B in FIG. 2.
Figure 4:
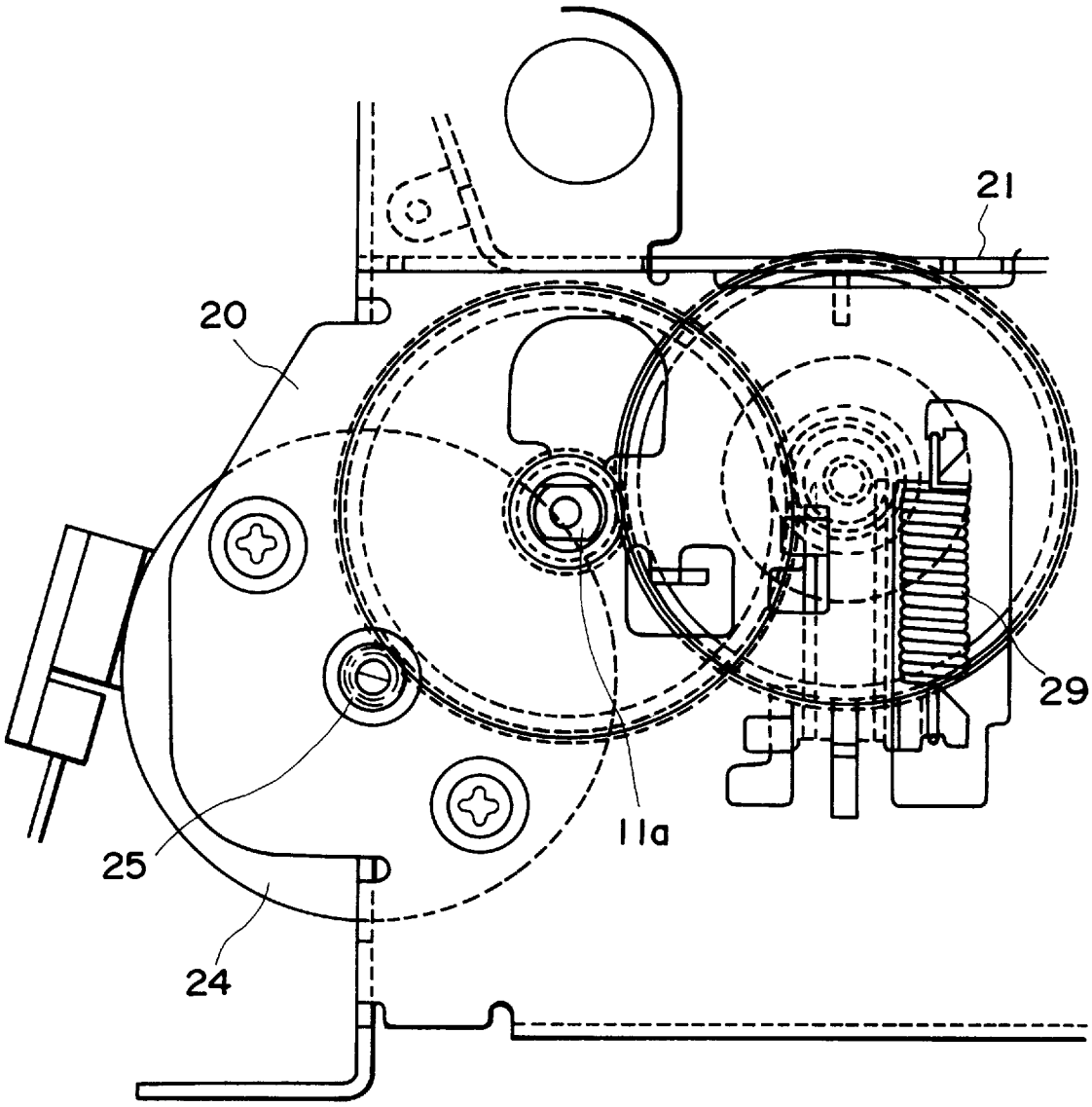
FIG. 4 is a side view, viewed from a direction shown by the arrow C in FIG. 2.
Figure 5:
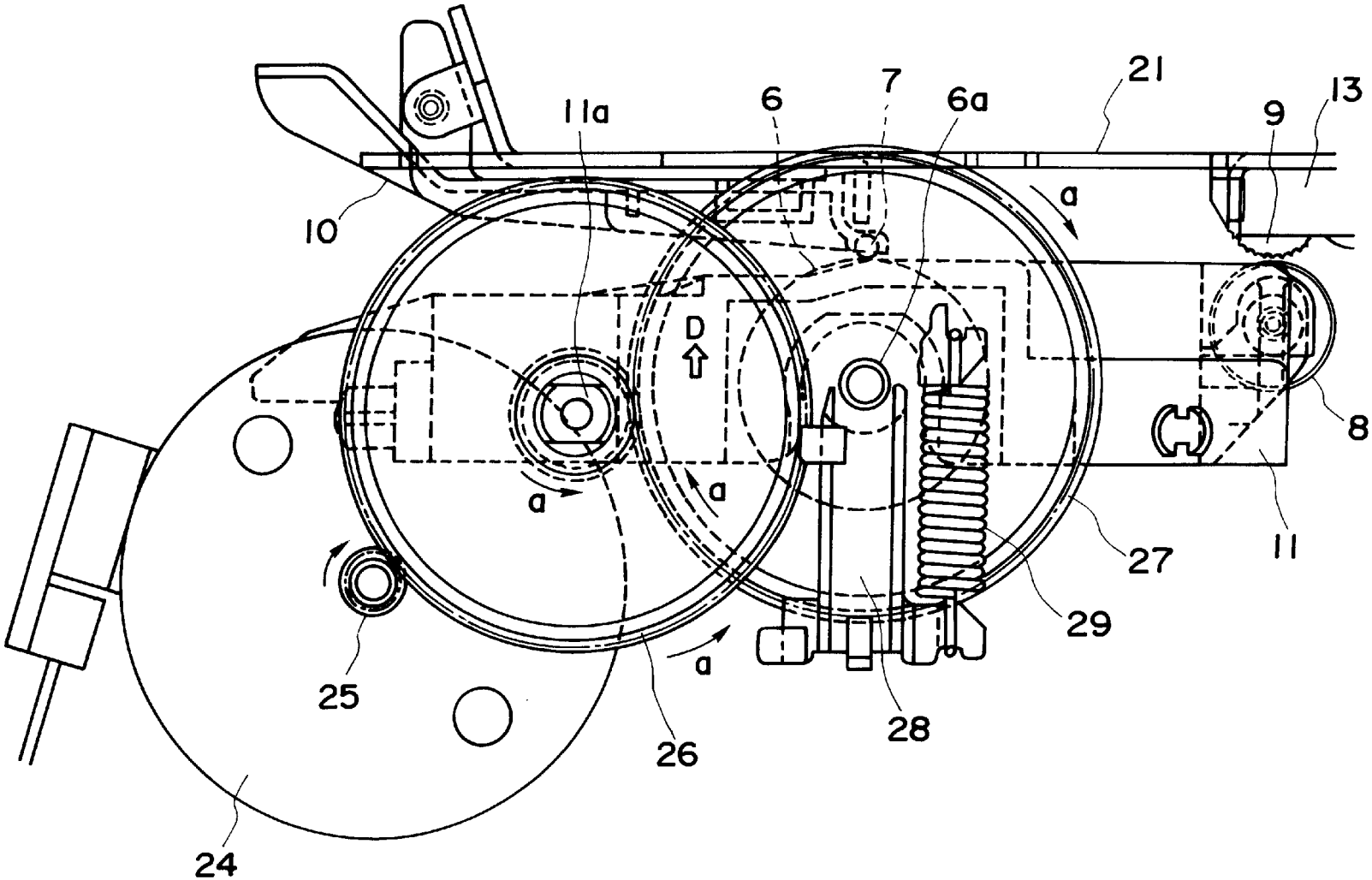
FIG. 5 is a side view of a drive transmitting portion of FIG. 4 (chassis is omitted from illustration)

FIG. 3 is a plan view showing a mechanism for transmitting a driving force to the convey roller 6, viewed from a direction shown by the arrow B in FIG. 2, FIG. 4 is a view showing a left side surface of the apparatus, viewed from a direction shown by the arrow C in FIG. 2, and FIG. 5 is a side view of a drive transmitting portion of FIG. 4.

The reference numeral 24 denotes a convey motor for generating a driving force for conveying the recording medium by the convey roller 6; 25 denotes a motor gear provided on a shaft of the convey motor 24; 27 denotes a convey roller gear provided on a shaft 6*a* of the convey roller 6; and 26 denotes a transmission gear for transmitting a driving force of the motor gear 25 to the convey roller gear 27. The reference numeral 28 denotes a bearing for supporting the shaft 6*a* of the convey roller 6; and 29 denotes a tension spring acting on the bearing 28 to generate, on the shaft 6*a* of the convey roller 6, a force for urging the convey roller 6 against the driven roller.

The convey motor 24 is attached to the chassis 20. The transmission gear 26 is attached to a shaft 11*a* provided on the convey roller holding member 11. The convey roller holding member 11 also has a shaft (not shown) similar to the shaft 11*a* at a right (FIG. 2) of the apparatus and is supported by the chassis 20 for pivotal movement around such shafts (11*a*).

Since the tension spring 29 is disposed between the bearing 28 supporting the shaft 6*a* of the convey roller 6 and the chassis 20, the convey roller 6 is subjected to moment directing toward an counterclockwise direction in FIG. 5 around the shafts 11*a* of the convey roller holding member 11, so that the convey roller 6 is urged against the driven roller 7 to generate a conveying force for conveying the recording medium. Since the driven roller 7 is held by the driven roller holding member 10 and the driven roller holding member 10 is held by the holding plate 21, the position of the driven roller is consistent or fixed, and, with the arrangement as mentioned above, the convey roller 6 can be pivoted while receiving the force for urging the convey roller against the driven roller. Thus, even when the recording media having different thickness are conveyed, the position of the member for determining the recording surface of the recording medium with respect to the recording head is not changed, so that the distance between the recording surface of the recording medium and the recording head 1 can be kept constant and the angle of the recording head relative to the recording surface is not changed.

Figure 6:
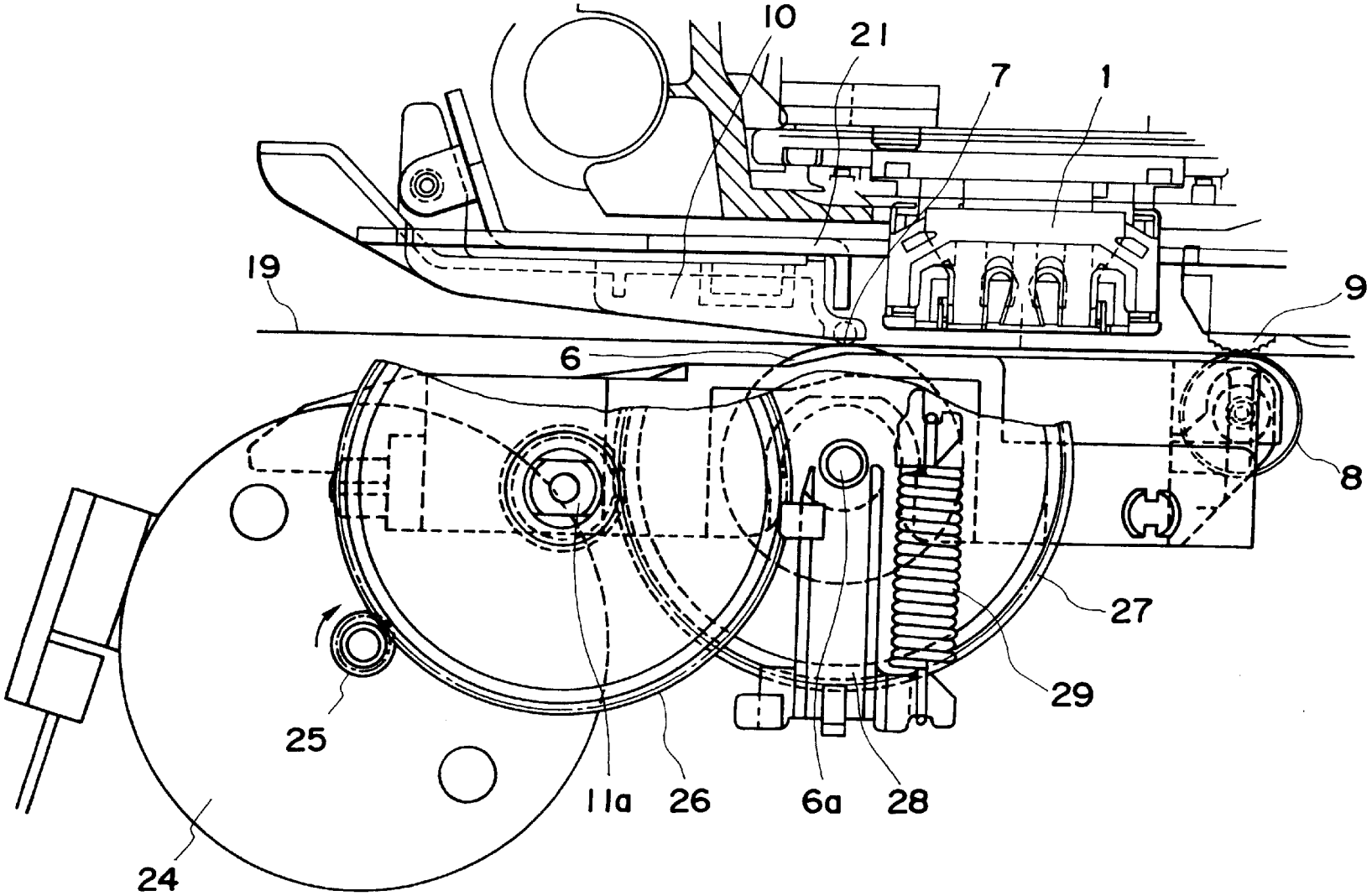
FIG. 6 is an explanatory view showing a condition that a thin recording medium is conveyed, in the embodiment of the present invention.
Figure 7:
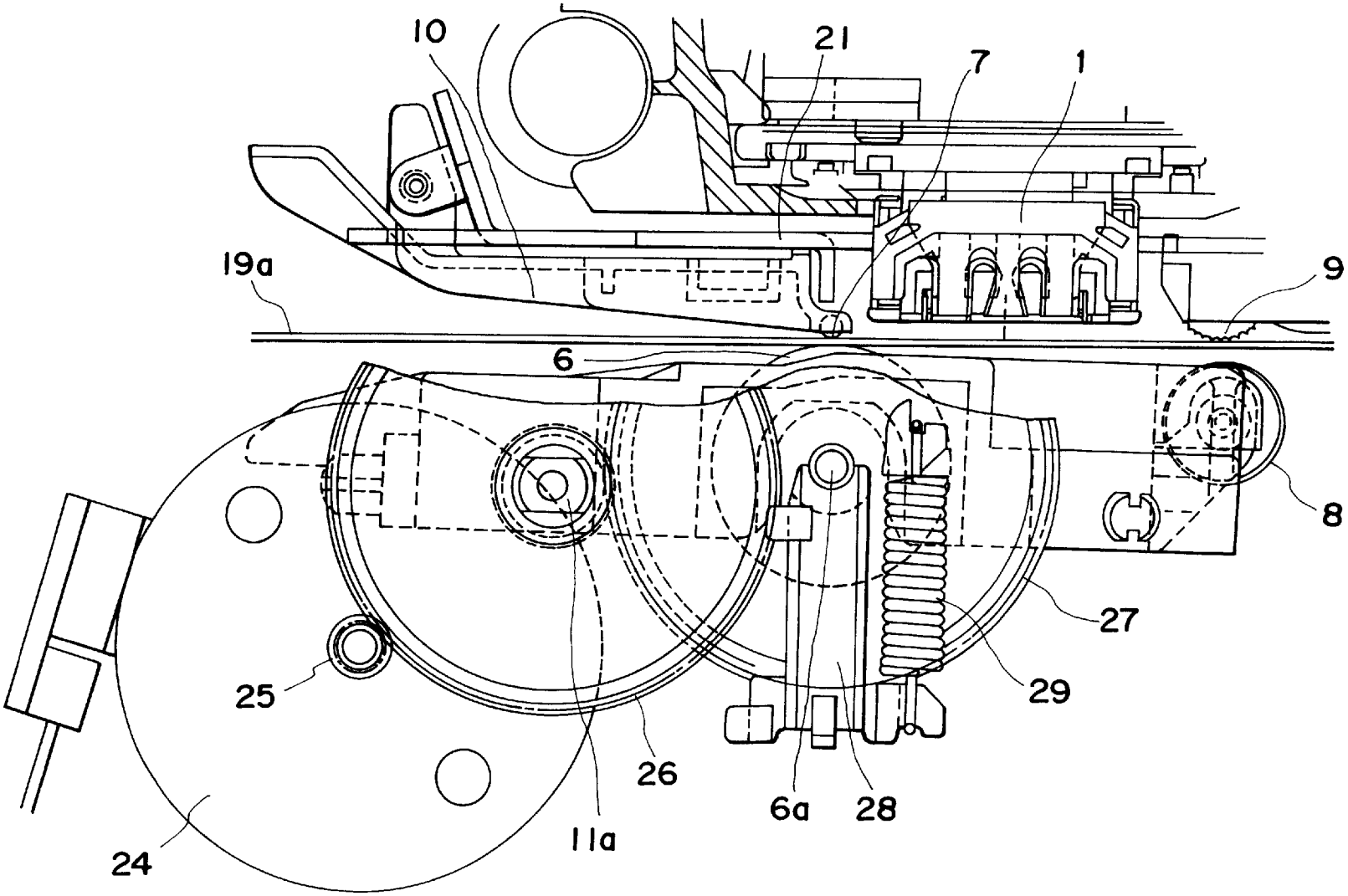
FIG. 7 is an explanatory view showing a condition that a thick recording medium is conveyed, in the embodiment of the present invention.
Figure 8:
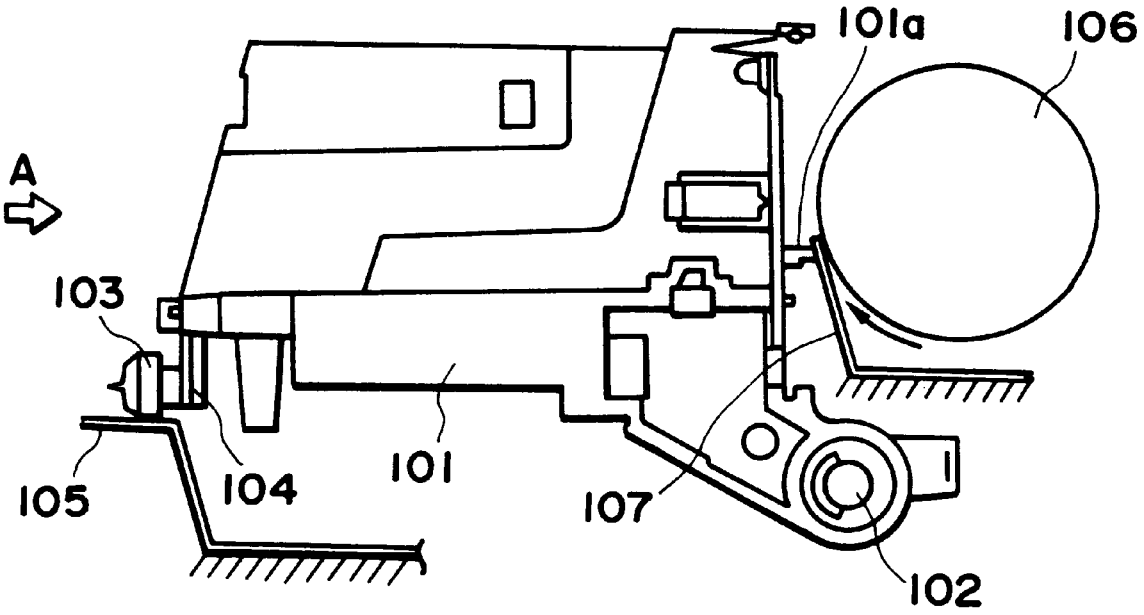
FIG. 8 PRIOR ART
FIG. 8 is an explanatory view showing a conventional recording apparatus.
Figure 9:
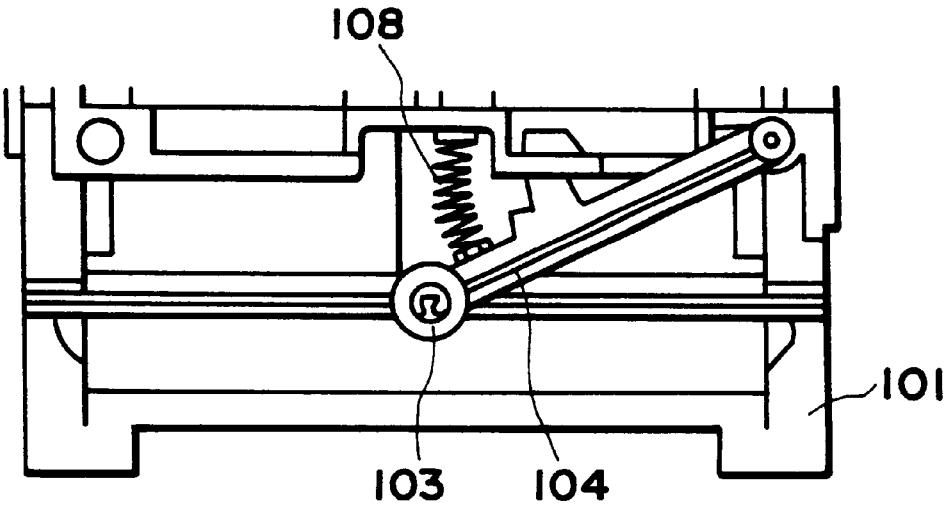
FIG. 9 PRIOR ART
FIG. 9 is a view of the conventional recording apparatus, viewed from a direction shown by the arrow A in FIG. 8.

FIG. 6 shows a condition that a thin recording medium 19 is conveyed, and FIG. 7 shows a condition that a thick recording medium 19 is conveyed. When the recording medium is conveyed in the recording medium conveying direction, the rotational directions of parts of the drive transmitting portion are directions shown by the arrows a in FIG. 5.

When the convey roller 6 is rotated in the recording medium conveying direction, the convey roller gear 27 is rotated in the clockwise direction. The rotation of the convey roller gear is transmitted from the transmission gear 26 which is rotated in the anti-clockwise direction when the convey roller 6 is rotated in the recording medium conveying direction. When the rotation is transmitted to the convey roller gear 27 by the transmission gear 26, at a meshing area between the transmission gear 26 and the convey roller gear 27, the convey roller gear 27 is subjected to a force directing toward a direction D (FIG. 5).

Since the rotation center of the transmission gear 26 coincides with the rotation center of the roller holding member 11, the convey roller gear 27 is subjected to moment directing in the anti-clockwise direction with respect to the rotation center of the convey roller holding member 11. Thus, when the convey roller 6 is rotated in the recording medium conveying direction, the convey roller gear 27 and the convey roller holding member 11 are subjected to moment directing in the anti-clockwise direction with respect to the rotation center 11*a* of the convey roller holding member 11. As a result, the convey roller 6 is subjected to the force for urging the convey roller against the driven roller 7, to thereby not cancel the spring force of the tension spring 29 for urging the convey roller 6 against the driven roller 7.

Incidentally, in the illustrated embodiment, while an example that the convey roller gear 27 receives the driving force from the transmission gear 26 was explained, for example, so long as a driving force receiving member (such as a gear supported by the convey roller holding member 11) is provided on the convey roller holding member, the similar technical effect can be achieved.

As mentioned above, according to the illustrated embodiment, since the distance and angle between the recording head 1 and the recording medium 19 is kept constant even when the thickness of the recording medium is changed, a high quality image can be obtained.

Regarding the positioning of the recording head 1 and the recording surface of the recording medium 19, unlike to the prior art, since such positioning is not effected by the member concerning to the main scan, any durability problems does not arise, to thereby always obtain a good image for a long term. Further, since the distance between the recording head and the recording surface of the recording medium is set to the predetermined value by positioning the holding member, the manufacturing cost of the recording apparatus can be reduced.

By adopting the arrangement in which the position of the driven roller disposed near the recording head is fixed and the convey roller disposed remote from the recording head is pivotable, unlike to a diameter of the convey roller, since a diameter of the driven roller does not affects a direct influence upon an conveying amount and conveying accuracy, the diameter of the driven roller can be selected freely. Thus, by using a driven roller having a smaller diameter, the distance between the recording head and the recording surface of the recording medium can be determined at a position nearer to the recording head, to thereby improve the accuracy of the distance between the recording head and the recording surface of the recording medium. Further, it is possible to increase a recording area of the recording medium held by the nip between the driven roller and the convey roller while keeping the distance between the recording head and the recording medium constant.

Since the convey roller is positioned at an opposite side of the recording head with respect to the recording medium, the diameter of the convey roller is not limited, and, thus, a diameter of the convey roller more preferable to the conveying amount and conveying accuracy can be selected, to thereby improve the conveying accuracy. As a result, a higher quality image can be obtained.

Incidentally, according to the illustrated embodiment, while an example that the convey roller 6 is disposed at the upstream side of the recording head 1 was explained, the convey roller may be disposed in a confronting relation to the recording head. Alternatively, the convey roller may be disposed at a downstream side of the recording head.

As mentioned above, according to the present invention, the convey rotary member can be pivoted with respect to the driven rotary member having the fixed position and the recording medium is conveyed by these rotary members and the image is recorded on the recording surface of the recording medium which is contacted with the driven rotary member by means of the downstream recording means. So, even when the thickness of the recording medium is changed, the distance and angle between the recording head and the recording surface of the recording medium can always be kept constant, to thereby obtain the good image. Further, since there is no (wear of a) projection for separating the recording head from an urging member, the durability can be improved.

What is claimed is:

1. A recording apparatus including a convey rotary member for conveying a sheet, a driven rotary member rotatably supported at a predetermined position to cooperate with said convey rotary member to convey the sheet, a recording means, disposed at the same side as said driven rotary member with respect to a sheet convey path, for effecting a recording on the sheet conveyed by said convey rotary member, and a first gear for transmitting a driving force to said convey rotary member, said recording apparatus comprising:

a rotatable support member, having a center of rotation, for supporting said convey rotary member and said first gear;

a second gear meshed with said first gear and supported for rotation around the center of rotation of said support member;

a drive means for rotating said second gear; and biasing means for biasing said convey rotary member in a direction in which said convey rotary member is pressed to said driven rotary member, wherein, when said convey rotary member is rotated in a direction in which the sheet is conveyed to said recording means via said second gear and said first gear, said support member is rotated in a direction in which said convey rotary member is pressed against said driven rotary member by a force generated by meshing between said first gear and said second gear.

2. A recording apparatus according to claim 1, wherein said driven rotary member is contacted with a recording surface of the sheet on which the recording is effected by said recording means.

3. A recording apparatus according to claim 1 or 2, wherein said recording means records an image on the sheet by discharging ink.

4. A recording apparatus according to claim 3, wherein said recording means includes an electrical/thermal converter for generating ink discharging thermal energy.

5. A recording apparatus according to claim 1, further comprising:

a second driven rotary member disposed rotatably at a constant position of downstream of said recording means; and a second convey rotary member disposed to be opposed against said second driven rotary member;

wherein said second convey rotary member is supported rotatably by said support member.

6. A recording apparatus according to claim 5, wherein said first gear and said driven rotary member are supported by a first shaft, said support member and said second gear are supported by a second shaft, and said support member is rotated around said second shaft.

7. A recording apparatus comprising:

a driven rotary member disposed rotatably at a constant position;

a convey rotary member disposed to be opposed against said driven rotary member;

biasing means for biasing said convey rotary member in a direction in which said convey rotary member is pressed to said driven rotary member;

recording means disposed at a downstream side of said convey rotary member and disposed at same side as said driven rotary member with respect to a convey path, for recording on a recording medium conveyed by said driven rotary member and said convey rotary member;

drive transmitting member for transmitting drive from a driving source to said convey rotary member to rotate said convey rotary member; and a rockable support member for supporting said convey rotary member rotatably;

wherein, when said convey rotary member is rotated by drive of said drive transmitting member in a direction in which the recording medium is conveyed to said recording means, said support member is rocked in a direction in which said convey rotary member is pressed against said driven rotary member.

8. A recording apparatus comprising:

a first driven rotary member disposed rotatably at a constant position;

a first convey rotary member disposed to be opposed against said first driven rotary member;

biasing means for biasing said first convey rotary member in a direction in which said first convey rotary member is pressed to said first driven rotary member;

recording means disposed at a downstream side of said first convey rotary member and disposed at same side as said first driven rotary member with respect to a convey path, for recording on a recording medium conveyed by said first driven rotary member and said first convey rotary member;

a second driven rotary member disposed rotatably at a constant position of downstream side of said recording means;

a second convey rotary member disposed to be opposed against said second driven rotary member;

drive transmitting member for transmitting drive from a driving source to said first convey rotary member and said second convey rotary member to rotate said first and second convey rotary members; and a rockable support member for supporting said first convey rotary member and said second convey rotary member rotatably;

wherein, when said first convey rotary member is rotated in a direction in which the recording medium is conveyed to said recording means, said support member is rocked in a direction in which said first and second convey rotary members are respectively pressed against said first and second driven rotary members.

9. A recording apparatus according to claim 8, wherein said drive transmitting member includes a first gear connected with said first convey rotary member and a second gear meshed with said first gear and rotated around a rocking center of said support member.

10. A recording apparatus according to claim 8, wherein a diameter of said first driven rotary member is smaller than that of said first convey rotary member.

11. A recording apparatus according to claim 10, wherein said recording apparatus is of ink jet recording type in which the recording is effected by discharging an ink from said recording means in response to a signal.

12. A recording apparatus according to claim 11, wherein said recording means includes an electrical/thermal converter for generating a thermal energy for discharging the ink.

13. A recording apparatus according to claim 12, wherein said recording means discharges the ink from a discharge opening by utilizing film-boiling generated in the ink by applying the thermal energy to the ink by means of said electrical/thermal converter.

14. A recording apparatus according to one of claims 7 to 9, wherein said recording apparatus is of ink jet recording type in which the recording is effected by discharging an ink from said recording means in response to a signal.

15. A recording apparatus according to claim 14, wherein said recording means includes an electrical/thermal converter for generating a thermal energy for discharging the ink.

16. A recording apparatus according to claim 15, wherein said recording means discharges the ink from a discharge opening by utilizing film-boiling generated in the ink by applying the thermal energy to the ink by means of said electrical/thermal converter.

* * * * *

UNITED STATES PATENT AND TRADEMARK OFFICE

CERTIFICATE OF CORRECTION

PATENT NO. : 5,947,615

DATED : September 7, 1999

INVENTOR(S) : KATSUYUKI YOKOI

It is certified that error appears in the above-identified patent and that said Letters Patent is hereby corrected as shown below:

ON TITLE PAGE, AT [56], REFERENCES CITED, FOREIGN PATENT DOCUMENTS

"4-115197" should read --6-115197--.

COLUMN 2

Line 24, "every" should read --for every--;
Line 25, "every" should read --for every--;
Line 65, "member. Wherein," should read --member, wherein,--

COLUMN 3

Line 54, "include" should read --includes--.

COLUMN 5

Line 10, "right" should read --right side--;
Line 16, "an" should read --a--.

COLUMN 6

Line 14, "to" should be deleted;
Line 16, "to" should be deleted; and "any" should read --no--;
Line 17, "does not arise," should read --arise,--;
Line 26, "to" should be deleted;
Line 27, "affects" should read --affect--;
Line 28, "an" should read --a--.

COLUMN 7

Line 42, "of downstream" --downstream--;
Line 63, "same" should read --the same--.

UNITED STATES PATENT AND TRADEMARK OFFICE

CERTIFICATE OF CORRECTION

PATENT NO. : 5,947,615

DATED : September 7, 1999

INVENTOR(S) : KATSUYUKI YOKOI

It is certified that error appears in the above-identified patent and that said Letters Patent is hereby corrected as shown below:

COLUMN 8

Line 23, "same" should read --the same--;
Line 29, "of downstream side" should read --downstream--.

Signed and Sealed this

Thirteenth Day of June, 2000

*Attest:*

*Attesting Officer*

Q. TODD DICKINSON

*Director of Patents and Trademarks*